United States Patent [19]

Dickakian

[11] Patent Number: 4,618,411

[45] Date of Patent: Oct. 21, 1986

[54] ADDITIVE COMBINATION AND METHOD FOR USING IT TO INHIBIT DEPOSIT FORMATION

[75] Inventor: Ghazi B. Dickakian, Kingwood, Tex.

[73] Assignee: Exxon Chemical Patents Inc., Florham Park, N.J.

[21] Appl. No.: 741,078

[22] Filed: Jun. 4, 1985

[51] Int. Cl.[4] ..... C10G 9/16

[52] U.S. Cl. ..... 208/48 AA; 585/4; 585/950; 252/8.3; 252/515 A; 252/401; 252/403; 252/406

[58] Field of Search ..... 208/48 AA; 585/950, 585/4; 252/8.55 B, 8.3, 51.5 A, 400, 399, 51.5 R, 401, 403, 406

[56] References Cited

U.S. PATENT DOCUMENTS

| | | | |
|---|---|---|---|
| 4,024,049 | 5/1977 | Shell et al. | 208/48 AA |
| 4,031,002 | 6/1977 | McKay | 208/48 AA |
| 4,116,812 | 9/1978 | Godar et al. | 208/48 AA |
| 4,190,462 | 2/1980 | De Jong et al. | 252/8.55 B |
| 4,193,891 | 3/1980 | McKay | 208/48 AA |
| 4,195,976 | 4/1980 | Ryer et al. | 208/48 AA |
| 4,216,076 | 8/1980 | Dillon et al. | 585/950 |
| 4,226,700 | 10/1980 | Broom | 208/48 AA |
| 4,265,711 | 5/1981 | Gleim | 208/48 AA |
| 4,529,500 | 6/1985 | Miller et al. | 208/48 AA |
| 4,569,750 | 2/1986 | Brownawell et al. | 208/48 AA |

*Primary Examiner*—Andrew H. Metz
*Assistant Examiner*—Anthony McFarlane
*Attorney, Agent, or Firm*—R. A. Dexter; R. L. Graham

[57] ABSTRACT

Deposit formation on the contact surfaces of structures containing heated hydrocarbon fluids such as refinery units, particularly units associated with the distilling process such as preheating stages, is inhibited by incorporating in the feed stock from 0.0001 to 0.01 weight percent of the combination of thiophene-containing polycondensed aromatic/naphthenic compounds of number average molecular weight ($\overline{M}n$) from 200 to 1000 and a macrocyclic polyamine of 2 to 8 nitrogen atoms per molecule and, if desired, at least one other additive such as an oil-soluble dispersant, antioxidant, antipolymerant, anti-foulant and mixtures thereof into said hydrocarbon stream.

14 Claims, No Drawings

ADDITIVE COMBINATION AND METHOD FOR USING IT TO INHIBIT DEPOSIT FORMATION

The present invention relates to improvements in anti-foulant processes in vessels confining heated hydrocarbon fluids such as liquid petroleum hydrocarbons. In a more particular sense, it relates to an additive combination and its use in a method for inhibiting the accumulation of harmful carbonaceous material in refinery process equipment and concomitant impairment of such equipment in which normally liquid feedstocks are used.

BACKGROUND OF THE INVENTION

The production of refinery products such as the various oil fractions, fuels and solvents involve the preheating of crude oils to from 150° C. to 350° C. prior to distillation into various fractions followed subsequent exposure of said fractions to higher temperatures of 350° C. to 700° C. As an illustration, most of the gasoline produced today is obtained by the thermal or catalytic cracking of heavier petroleum hydrocarbon feed stocks such as light or heavy gas oils, cycle stocks, virgin or topped crude oils, lube stocks, kerosene, and kerosene-gas oil mixtures. A number of different thermal and/or catalytic cracking processes are industrially used for this purpose. Although these various processes differ considerably as to the precise manner in which the heavier hydrocarbon molecules are cracked to yield gasoline, they all involve the heating of the hyrocarbon feed stock to a high temperature (150°–370° C.) and the passing of such heated stock, optionally mixed with a cracking catalyst, through heated tubes, reactors, convertors, and tower stills.

Regardless of the refinery process used, the distillation and/or cracking operation (particularly the former) always results in the formation of undesirable carbonaceous material which accumulates on the inner surfaces of the preheating and/or cracking unit to markedly reduce its heat transfer efficiency, substantially increase the pressure drop of the hydrocarbon stream and block the process flow. This fouling of the heat-exchanger or other process equipment such as furnace tubes, is a costly major, unresolved problem throughout refineries and petrochemical plants, since the fouled unit must be dismantled, cleaned, and reassembled. Of course, such cleaning operations are not only tedious and costly, but result in a large proportion of "downtime" during which the unit is not functioning.

Generally, the carbonaceous deposition can be separated into the lower temperature (<400° C.), long time (minutes to hours) deposits which are hexane insoluble and quinoline soluble and the higher temperature (>750° C.), short time (seconds) coke deposits which are hexane insoluble and quinoline insoluble.

Anti-foulant processes to reduce (inhibit) quinoline-soluble carbonaceous deposits include those set forth in: U.S. Pat. No. Re. 26,330 wherein deposit formation in refinery units is inhibited by incorporating in the feed stock a small percentage (usually about 0.0012–0.04 weight percent) of an acylated amine prepared by reacting a hydrocarbon-substituted succinic acid with an alkylene amine; and, U.S. Pat. No. 4,195,976 wherein fouling of process equipment by an oil stream in refinery operations is reduced by incorporating in the feed from 0.001 to 2 wt.% of a bis-oxazoline reaction product of polyisobutenylsuccinic anhydride with a 2,2 disubstituted-2-aminol-alkanol, such as tris-hydroxy methylaminomethane (see U.S. Pat. No. 4,195,976).

Approaches to the reduction of coke (carbonaceous coating insoluble in both quinoline and hexane) formation in cracking furnace tubes includes: U.S. Pat. No. 2,621,216 which discloses that coke formation during steam pyrolysis of ethane, propane, or mixtures thereof may be reduced by incorporating from 0.2 to 0.5 volume percent of a sour refinery gas (containing $H_2S$) in the pyrolysis feedstock (Col. 7, line 19–75); U.S. Pat. No. 3,437,174 which discloses that incorporation of up to 25% propylene in a naphtha pyrolysis feedstock improves yield selectivity to ethylene without any increase in coking (Col. 2, line 31–48); U.S. Pat. No. 3,536,776 which discloses that thermal cracking of hydrocarbons, may be carried out in a metalceramic reaction tube with significantly reduced carbon formation (Col. 2, line 5–13 and line 56–63 and Col. 4, line 27–42); U.S. Pat. No. 3,842,138 which discloses that, in steam cracking, the carbon to hydrogen ratio of the feedstock is important with respect to coking, aromatics can only be tolerated in the feedstock because of their refractory nature, and small amounts of sulfur in feedstock have favorable effect against coking (Col. 4, line 37 to Col 5, line 2); and, Green et al in *Hydrocarbon Processing,* September 1975, pp. 164–168, at page 165 contends that gas oil cracking is disadvantageous compared with naphtha cracking because of lower yields and because higher yields of pyrolysis fuel oil are produced which contain highly aromatic material that is a precursor of tars and coke; whereas, U.S. Pat. No. 4,176,045 discloses that a blending (4 to 20%—see Table 2–5) amounts of low coking liquid hydrocarbon, such as pyrolysis fuel oil with the feedstock prior to introducing the latter into the tubular furnace reduces coke formation.

It is an object of the present invention to inhibit the accumulation of harmful carbonaceous material on the inner surfaces of vessels confining a heated hydrocarbon fluid.

Another object is to disperse the carbonaceous material formed during the preheating of a crude oil and thereby inhibit its accumulation (fouling) on the various parts of the inner wall of the heat exchanger prior to its introduction into a crude distillation unit.

Yet another object is to reduce the amount of downtime, reduce fuel costs and/or increase hydrocarbon throughput in the operation of refinery heat exchangers and cracking units.

SUMMARY OF THE INVENTION

In accordance with the objects of this invention, there is provided an hydrocarbon process stream in refinery operations which has been inhibited to prevent fouling of process equipment by incorporation of at least an anti-fouling amount of the combination of oil-soluble, thiophene-containing polycondensed aromatic/naphthenic compounds of number average molecular weight ($\overline{M}n$) from 200 to 1000 and an oil-soluble macrocyclic polyamine having 2 to 8 nitrogen atoms per molecule, reduces the tendency of said hyrocarbon stream to deposit carbonaceous material on the metal surface of heater exchanger, furnace tubes, reactor walls and other processing equipment through which said heated stream is flowed, additive such as an oil soluble dispersant, antioxidant or antipolymerant into said oil stream. It has been discovered that introducing from 25 to 100 parts per million (hereinafter ppm) of an alkylated thiophene-containing polycondensed aromatics/naphthenic compounds of number average molecular weight from 200 to 1000 and said oil-soluble macrocyclic polyamine into a heated hydrocarbon stream such as crude oil or crude residue reduces the tendency of said hydrocarbon stream to deposit carbonaceous material on the hydrocarbon contacted surface of a heater exchanger, furnace tube, reactor wall and other processing equipment through which said heated stream flows.

Therefore, in accordance with this invention, there is provided an oil stream in refinery operations which has been inhibited to prevent fouling of process equipment by incorporation of from 0.0001 to 0.01, preferably 0.001 to 0.005, optimally 0.008 to 0.003, weight percent of oil soluble alkylated thiophene-containing polycondensed aromatics/naphthenic compounds of number average molecular weight ($\overline{M}n$) from 200 to 1000 and an oil-soluble macrocyclic polyamine having 2 to 8 nitrogen atoms per molecule and if desired, at least one other additive such as an oil soluble dispersant, anti-oxidant or anti-polymerant into said oil stream. Since it has been discovered that the oil soluble thiophene-containing polycondensed aromatics/naphthenic compounds of 200 to 1000 $\overline{M}n$ can be recovered from various sources it is within the concept of the process of the invention to use said sources in amounts appropriate to provide anti-fouling activity in combination with said oil-soluble macrocyclic polyamine in amounts ranging from 0.0002 to 0.03 ppm. It is also within the scope of the invention to provide the useful combination of additives, (i.e. aforesaid aromatic/naphthenic compound(s) and macrocyclic polyamine), as an article of commerce for use as a product having the unique anti-foulant activity in liquid petroleum hydrocarbons.

DETAILED DESCRIPTION OF THE INVENTION (A) Thiophenic Anti-fouling Additive

One of the anti-fouling agents of the combination, which is the subject of this invention, is composed of polycondensed aromatic/naphthenic compounds with thiophenic structure preferably alkylated ($C_2C_{12}$) polycondensed aromatic/naphthenic compounds with thiophenic structures and having a number average molecular weight ranging from 200 to 1000. These compounds are basically composed of hydrocarbon and sulfur, but may contain small quantities of other polar atoms such as oxygen and nitrogen. The composition and the chemical structure of the anti-fouling agent can be defined quantitatively by a number of analytical methods including carbon and proton nuclear magnetic resonance spectroscopy, high-resolution mass spectroscopy, high-performance liquid chromatography and thermal analysis.

The anti-fouling agent can be synthesized or derived from various hydrocarbon streams in the petroleum, chemical and coal industries as by fractionation. These streams can be used alone, or blends of the fractions obtained by atmospheric, steam or vacuum distillation, or liquid-liquid extraction. Useful streams may be obtained from one or more of the following sources: thermal or catalytic cracking of petroleum distillates; steam cracking of naphtha and gas oil; coal processing including liquefication, gasification and carbonization; and, aromatic extracts from lubricating oil processing.

The useful streams are characterized by the presence of alkylated ($C_2$–$C_{12}$) polycondensed aromatic/naphthenic thiophenic compounds with ($\overline{M}n$) of 200 to 1000, preferably from 200 to 300, which typically have a boiling range from 200° C. to 550° C. at atmospheric pressure and which are found in combination with sulfur-free compounds of similar structures. As indicated, the various sources of the anti-fouling agent which is used in this invention provide a stream which contains two major components according to high resolution mass spectroscopic analysis. One component is composed of sulfur-free compounds having a formula ranging from $C_nH_{2n-8}$ to $C_nH_{2n-36}$. The second major component is a thiophene containing alkylated polycondensed aromatic/naphthenic compounds with the molecular formula ranging from $C_nH_{2n-12}S$ to $C_nH_{2n-36}S$.

Another method to characterize a stream useful as an antifouling additive according to the invention is provided by high performance liquid chromatography wherein the stream is fractionated using specific chromatographic columns into a saturate fraction, a neutral aromatic fraction and a polar aromatic fraction. Generally, the streams which are useful as anti-fouling agents contain 29 to 43% of a saturate fraction, 7 to 56% of neutral aromatic fraction and 14 to 48% of a polar aromatic fraction.

(B) Macrocyclic Amine Anti-fouling Additive

The other anti-fouling agent of the combination which is the subject matter of this invention is an oil soluble polyamine having 2 to 8 nitrogen atoms per molecule. Such a polyamine is represented by an oil soluble macrocyclic polyamine compound having the formula:

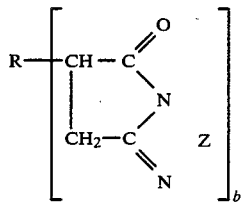

where R is a hydrocarbon having 20 to 15,000 carbon atoms, b is 1–150, Z may be:

$$-CH_2CH_2CH_2-;$$
$$(CH_2CH_2CH_2NH)_nCH_2CH_2CH_2-$$

where n is 1–6 or:

$$(CH_2CH_2CH_2NH)_mCH_2CH_2(NH-CH_2CH_2CH_2)_{m'}-$$

wherein m+m' is 2–5.

The macrocyclic polyamine required for the purposes of this invention is described in detail in the copending application Stanley J. Brois, et. al., Ser. No. 453,143, filed Dec. 27, 1982.

In the interest of not unduly lengthening the present specification, it is intended that the disclosure of the said Brois et. al. application be considered as forming a part of the present specification.

In summary, application Ser. No. 453,143 deals with compositions of oil-soluble, macrocyclic polyamine compounds, being the reaction product in a cyclodehydration reaction of a hydrocarbon substituted succinic anhydride, with a poly 3-amino propyl amine compound, having 2 to 8 nitrogen atoms, the oil soluble macrocyclic polyamine compound being a member of the group of compounds represented by the following formulas, or mixtures of said compounds:

I

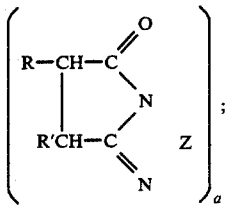

II

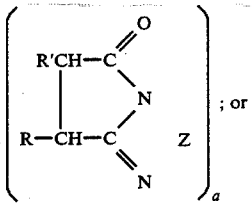

III

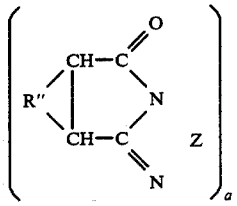

wherein R′ is hydrogen or lower $C_1$–$C_{12}$ alkyl, R is a hydrocarbon substituent having 20 to 15,000 carbon atoms, R″ is a hydrocarbon substituent of 4 to 15,000 carbon atoms having two of its carbon atoms bonded to the alpha carbon atoms of the cyclodehydrated succinic anhydride moiety, Z may represent:

$$-CH_2CH_2CH_2-,-(CH_2CH_2CH_2NH)_nCH_2CH_2CH_2-$$

where n is 1–6 or:

$$-(CH_2CH_2CH_2NH)_mCH_2(CH_2)p(NH-CH_2CH_2CH_2)m'-$$

where m and m′ are each at least 1 and m+m′ is 2–5, p is 1–4 and a is an integer 1–20.

Formulas I and II above are meant only to represent different isomers which will form as a result of formation of the hydrocarbon substituted succinic anhydride. A typical product will be a mixture of isomers such as about 50–90% of the Formula I syn-isomer and the balance the Formula II anti-isomer. Formula III would be illustrated by a Diels-Alder type reaction in the preparation of polyisobutenyl succinic anhydride from chlorinated polyisobutylene and maleic anhydride where two reactive sites are provided for bonding the polymer backbone to each of the alpha carbon atoms of the anhydride moiety. Embodiment would be represented by a formula wherein Z is trimethylene and a is 1:

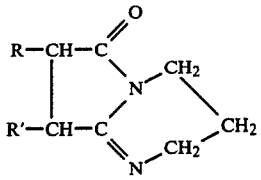

and this compound would therefore be derived from 1, 3-propanediamine.

Larger macrocyclic structures can be represented by this structure below wherein Z is:

$$-CH_2CH_2CH_2NHCH_2CH_2CH_2-$$

and a is 1:

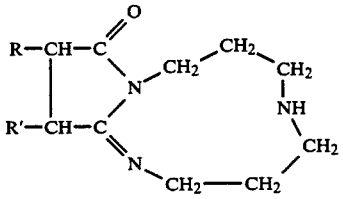

and in the next structure below, a is 1 and Z is a polyamino alkylene unit of the formula:

$$-(CH_2)_3-NH-(CH_2)_3-N-H-(CH_2)_3-NH(CH_2)_3-:$$

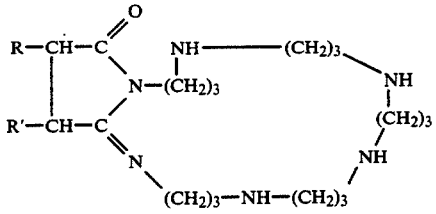

The variation of a between 1 and 20 is intended for numbers greater than 1 to represent multi-site macrocyclic polyamines, that is, those products derived from polyfunctionalized hydrocarbon succinic anhydrides having more than 1 succinic anhydride group per mole of hydrocarbon substituent. Usually, such as for ethylenepropylene copolymer substituted succinic anhydrides, the value of "a" may vary from about 1 to about 10. The preferred value is about 1 to 8, with multi-site products derived from ethylene propylene copolymers and terpolymers of $\overline{Mn}$ 10,000 to 200,000 being particularly preferred with a corresponding preferred value for a of from about 2 to 20, since these products have good viscosity modifying and/or anti-foulant properties.

Other useful macrocyclic polyamine compounds may also be formed by reacting the same category of poly-(3-aminopropyl)amine reagents with a monocarboxylic acid to give macrocyclic compounds having the general formula:

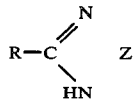

wherein R and Z are as described above. Similarly, useful macrocyclic polyamine compounds may be prepared from poly-carboxylic acids or polymers such as ethylene-propylene graft copolymer with acrylic acid or alternating copolymers of ethylene-acrylic acid or vinyl etheracrylic acid in accordance with the cyclodehydration reaction process of the invention to give macrocyclic compounds, which may be generalized as:

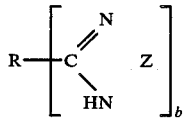

wherein b is an integer of 2 or more representing compounds derived from poly-carboxylic acids hving 2 or more reactive carboxylic groups. The upper limit of b is a value of about 150. R and Z are as previously defined.

These embodiments depend upon the use of polyamines having terminal 3-amino propyl groups including both simple diamines such as 1,3-propane diamines, 3,3′-imino-bis-propylamine, N,N-bis(3-amino propyl-)ethylene diamine and higher oligomers such as pentapropylene hexamine. Further embodiments include polyamino propyl amines having C-substituents such as $C_{12}$–$C_{20}$ alkyl, $C_6C_{10}$ aryl, hydroxyl, thio, cyano, ethoxy, polyoxyethylene and polyoxpropylene having a degree of polymerization of 2–10 and other compatible non-reactive functional groups, but N-substituted polyamines are not suitable reactants in preparing the macrocyclic compounds of this invention in a cyclodehydration reaction. Other amines not meeting these requirements, such as ethylene and 1,2-propylene amines will, upon aminolysis, give non-cyclic imide type products not within the scope of this invention as opposed to the macrocyclic structures utilized in accordance with the invention, the cyclic structure being the essential property for use in the process of the invention.

Suitable amines for the cyclodehydration reaction may be generalized by the formula $NH_2$—Z—$NH_2$, where Z is as described above. The carbon atoms may contain substituents as noted above, but the nitrogen atoms must be either —NH— or —$NH_2$. Preferably Z is:

$$-CH_2CH_2C-$$
$$H_2-,-(CH_2CH_2CH_2NH)_mCH_2CH_2CH_2-$$

where n is 1–3 or:

$$(CH_2CH_2CH_2)_m(CH_2CH_2)(NHCH_2CH_2CH_2)_m.$$

where m′ are as described above.

Formation of the macrocyclic and polyamine compounds proceeds by aminolysis of the hydrocarbyl substituted succinic anhydride, monocarboxylic acid or poly-carboxylic acid using an inverse mode of addition. Such a process will avoid the formation of the non-cyclic, imide products or other products resulting from chain extension. The first step of the synthesis is to slowly add the succinic anhydride or monoor poly-carboxylic acid to the polyamine compound at relatively low temperatures, such as from room temperature, that is, about 20° C., up to about 150° C. in an inert hydrocarbon solvent, such as xylene, toluene, dichlorobenzene or a neutral paraffinic mineral oil. This inverse mode of addition is critical to form the 1:1 amic acid or amine carboxylate salt intermediate and inhibit or prevent formation of imide or amide non-cyclic final products. The reaction temperature during this inverse addition of hydrocarbon succinic anhydride or carboxylic acid should be as low as possible, preferably below 100° C., and the optimum temperature will vary somewhat depending on the reactivity and structure of cyclodehydration to the desired macrocyclic polyamine product. In contrast to this, adding the polyamine to the hydrocarbon succinic anhydride, produces linear imide products.

The hydrocarbon substituted succinic anhydrides reacted with the poly (3-amino propyl) reagents or performed cyclic amines, in accordance with this invention, are derived generally from oil soluble hydrocarbons comprising unbranched saturated or unsaturated hydrocarbon chains of at least 8, preferably at least 50 carbon atoms, including both polymeric, oligomeric and nonpolymeric aliphatic chains, particularly polymers of $C_2$–$C_5$ olefins. Preferable for use is the thermal polyisobutenyl succinic anhydride of $\overline{M}n$ about 900 to 2,000 produced in the "enormation".

The second step of the process, the cyclodehydration of the amic acid or amine carboxylate intermediate, is effected at a temperature consistent with the reactivity of the intermediate salt, with suitable cyclodehydration temperatures ranging from 110°–250° C. Formation of the macrocyclic polyamine structure is indicated by cessation of evolution of water and by the maximization of the C═N absorption band at about the 6 micron range in the infrared spectrum of the reaction product.

It is critical to the cyclodehydration process that this inverse mode of addition be used to effect the aminolysis of the succinic anhydride or carboxylic acid. Thus, the slow addition of hydrocarbon succinic anhydride or carboxylic acid to the well stirred polyamine, preferably in solution, maintained at about 20° to 150° C. maximizes the formation of the 1:1 intermediate salt, which upon further heating at 110°–250° C., undergoes cyclodehydration to the desired macrocyclic polyamine product. In contrast to this, adding the polyamine to the hydrocarbon succinic anhydride, produces linear imide products.

The hydrocarbon substituted succinic anhydrides reacted with the poly (3-amino propyl) reagents or preformed cyclic amines in accordance with this invention are derived generally from oil soluble hydrocarbons comprising unbranched saturated or unsaturated hydrocarbon chains of at least 8, preferably at least 50 carbon atoms including both polymeric, oligomeric and nonpolymeric aliphatic chains, particularly polymers of $C_2$–$C_5$ olefins. Preferable for use in the thermal polyisobutenyl succinic anhydride of $\overline{M}n$ about 900 to 2,000 produced in the "ene" reaction by heating together polyisobutylene and maleic anhydride at about 200° C., although chlorinated polyisobutylene can be used as the precursor as well.

In another process embodiment macrocyclic and polycyclic polyamines can be prepared by condensing the hydrocarbon succinic anhydrides with macrocyclic polyamines (aza crown compounds) and polycyclic polyamines (aza polycycles) in an acylation reaction. Aza crown compounds useful herein are those having at least 2 NH groups and may be represented by the formula:

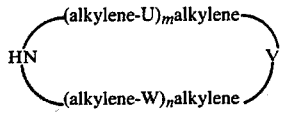

wherein U, V and W can be NH, S and/or O, n or m is an integer of 1 to about 4, alkylene is $C_2$–$C_4$, usually an ethylene or trimethylene group, and these aza crown compounds include macrocyclic polyamines (U=V=W=NH), polyether amines (U=W=O, V=NH, etc.) and polythioether amines (U=W=S, V=NH).

Examples within the scope of the foregoing formula are macrocyclic polyamines and their complexes having three to about eight nitrogen atoms, at least one, which is an NH group. Preferred are those having four nitrogen donors in cycles containing about 12 to 16 atoms. Examples of useful macrocyclic polyamines include 1,4,8,11-tetraazacyclotetradecane (cyclam), 1,4,7,10-tetrazacyclododecane, 1,4,7,10,13,16-hexaazacyclotadecane (hexacyclene).

Also suitable are mixed donor macrocyclic amines containing nitrogen-oxygen, nitrogen-sulfur, and nitrogen-oxygen-sulfur donor groups as depicted below which can be acylated to give useful lubricant additives:

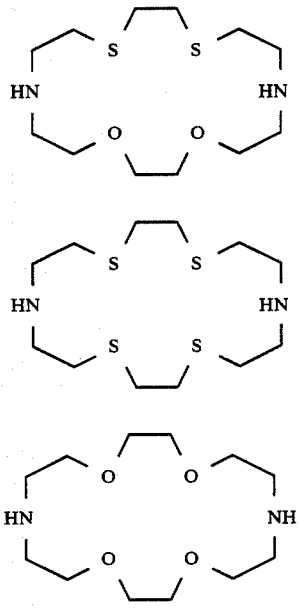

Also useful are aza polycyclic ring assemblies (aza polycycles) containing 2 to 3 rings having 5 to 6 atoms in the ring, including 3 or 4 nitrogen atoms, at least one being an NH group, but preferably 2–3 NH groups per molecule are present, which compounds can be represented by the formulas:

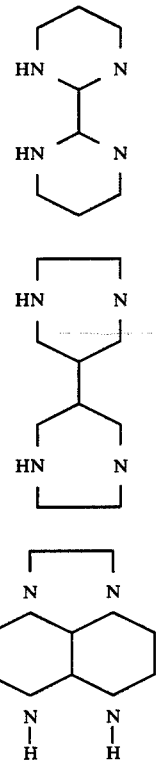

These amino compounds may be acylated by reacting at least a half-mole equivalent up to a 2 mole equivalent of the aforementioned hydrocarbon substituted succinic anhydrides.

Further embodiments reside in the formation of metal complexes and other post-treatment derivatives, e.g. borated derivatives, of the novel macrocyclic additives prepared in accordance with this invention. Suitable metal complexes may be formed in accordance with known techniques of employing a reactive metal ion species after the reaction of the polyamine and the hydrocarbyl anhydride compound. Complex-forming metal reactants include the nitrates, thiocyanates, halides, carboxylates, phosphates, thiophosphates, sulfates, and borates of transition metals such as iron, cobalt, nickel, copper, chromium, manganese, molybdenum, tungsten, ruthenium, palladium, platinum, cadmium, lead, silver, mercury, antimony and the like. Prior art disclosures of these complexing reactions may be found in U.S. Pat. Nos. 3,306,908 and Re. 26,433.

Post-treatment compositions include reacting the macrocyclic additives with one or more post-reacting reagents, usually selected from the group consisting of boron oxide, boron oxide hydrate, boron halides, boron acids, sulfur, sulfur chlorides, phosphorous sulfides and oxides, carboxylic acid or anhyride acylating agents, epoxides and episulfides and acrylonitriles. The reaction of such post-treating agents with the macrocyclic polyamine compounds is carried out using procedures known in the art. For example, boration is accomplished in accordance with the teachings of U.S. Pat. No. 3,254,025 by treating the macrocyclic polyamine compound with a boron oxide, halide, ester or acid to provide about 0.1 to 1 atomic proportions of boron for each atomic proportion of nitrogen in the composition.

Treatment is carried out by adding about 1-3 weight percent of boron compound, preferably boric acid, and heating and stirring the reaction mixture at about 135° C. to 165° C. for 1 to 5 hours followed by nitrogen stripping and filtration, if desired. Mineral oil or inert organic solvents facilitate the process.

Specific examples of macrocyclic polyamines which are disclosed in detail in Application Ser. No. 453,143 and which are useful as the macrocyclic polyamine derivative (MPD) herein are shown in Table I:

TABLE I

| Ex. No. of Ser. No. 453,143 | PIBSA[1] Reacted with the Polyamine | MPD % N |
|---|---|---|
| B7 | 4,7-diazadecane 1,10-diamine (DADD) | 1.98 |
| B8 | DADD | 1.57 |
| B9 | DADD | 1.83 |
| B12 | (TAOD mixture)[2] | 2.54 |

As indicated, the various sources of the anti-fouling agent which is used in this invention provide a stream which contains two major components according to high resolution mass spectroscopic analysis. One component is composed of sulfur-free compounds having a formula ranging from $C_nH_{2n-8}$ to $C_nH_{2n-36}$. The second major component is a thiophene containing alkylated polycondensed aromatic/naphthenic compounds with the molecular formula ranging from $C_nH_{2n-12}S$ to $C_nH_{2n-36}S$.

Another method to characterize a stream useful as an anti-fouling additive according to the invention is provided by high performance liquid chromatography wherein the stream is fractionated using specific chromatographic columns into a saturate fraction, a neutral aromatic fraction and a polar aromatic fraction. Generally, the streams which are useful as anti-fouling agents contain 29 to 43% of a saturate fraction, 7 to 56% of neutral aromatic fraction and 14 to 48% of a polar aromatic fraction.

The anti-fouling amount of the anti-fouling combination needed to inhibit fouling will depend upon its chemical structure and its concentration in the stream being processed. A useful treatment range of the agent for the hydrocarbon fluid is from 0.0001 to 0.5, preferably 0.0001 to 0.1, optimally 0.0008 to 0.003, weight percent based on the weight of the hydrocarbon fluid.

The other additives which can be used in combination with the anti-fouling combination useful in this invention are dispersants, antioxidants, antipolymerants or free-radical scavengers, other anti-foulants and mixtures thereof.

Suitable representative dispersants include the acylated nitrogen compounds such as polyisobutylene succinimides of polyalkylene polyamines (see U.S. Pat. No. 3,272,746) and their borated derivatives, esters of long chain dicarboxylic acids such as polyisobutenylsuccinic anhydride esterified with a polyol, such as pentaerythritol (see U.S. Pat. No. 3,381,002) or with a hydroxy amine, such as ethanolamine (see U.S. Pat. No. 3,272,746), mono and bis oxazolines of polyisobutenyl succinic anhydride (see U.S. Pat. No. 4,049,564) lactone esters reaction products of hydrocarbon substituted lactone carboxylic acid with polyols (see U.S. Pat. No. 4,123,373), thiobisacyl esters (see U.S. Pat. No. 4,417,062), sulfonates and sulfonic acids such as $C_{28}$-$C_{32}$ alkyl benzene sulfonic acid (see U.S. Pat. No. 4,182,613) and thio-bis-oxazolines (see U.S. Pat. No. 4,292,184).

Representative antioxidants are the zinc dihydrocarbylsubstituted dithiophosphates such as zinc dinonylphenyl dithiophosphates such as zinc dinonylphenyl dithiophosphate (see U.S. Pat. No. 4,085,053), nonyl phenol sulfide, the known class of hindered amines such as N-phenyl naphthylamine, tri alkyl tri aryl phosphite, trithiones produced by the reaction of an olefin such as diisobutylene and triisobutylene with elemental sulfur, tert-octyl phenol sulfide, 4,4'-methylene bis(2,6-diterbutyl phenol), fatty acid thiocyanates such as lauroyl thiocyanate and stearoyl thiocyanate (see U.S. Pat. No. 2,168,674) and thiocarbamyl derivatives (see U.S. Pat. No. 4,303,539).

Suitable antipolymerants are such as phenolic derivative, e.g., 2,6-di-tert-butyl phenol and its derivatives such as 4,4'-methylene-bis-(2,6-di-tert-butylphenol) or other molecules which can be used to act as free radical scavenger known in the arts.

Generally, the anti-fouling combination of the invention is used with from 0.1 to 10, preferably 1 to 8 weight parts of agent to each total weight part of other additive(s). Generally the alkylated thiophene is used with from 0.1 to 10, preferably 1 to 8, optimally 0.5 to 2, weight parts of thiopene to each weight part of the macrocyclic polyamine.

Although the process of this invention is applicable to all crude stocks and refined hydrocarbon liquids generally found in a refinery, it is particularly useful for fouling inhibition of those crude stocks containing less than 50, more particularly less than 40 and highly applicable for less than 30, weight percent total aromatic content of the liquids as defined by high performance liquid chromatography.

The process of the invention is also particularly useful for the treating of those oils heated to temperatures of less than about 400° C. When the oils are so heated for periods of minutes to hours, e.g., in the preheating of crude oil prior to its passage into the primary distillation tower and/or the heat removal from the bottoms flow from said tower, the carbonaceous fouling layer which develops to detrimental thicknesses in months is quinoline soluble. In contrast, a coke layer is neither quinoline nor hexane soluble. Thus, the formation of a quinoline soluble fouling layer such as is found in heat exchangers and similar process equipment is particularly effectively inhibited when oils subjected to heating temperatures of less than about 400° C. are processed according to this invention.

All of the following Examples cited herein demonstrating the fouling characteristics of treated and untreated crude utilized a laboratory test apparatus identified herein as a Thermal Fouling Tester.

The Tester is a modification of the Alcor Jet Fuel Oxidation Tester described in ASTM Vol. 50 -D3241. It is configured to allow measurement of the fluid temperature at the exit of the heat exchanger while the metal temperature of the heated tube is controlled. The test thus measures the change in temperature of a fluid which has been pumped across a heated surface. The outlet temperature is directly related to the heat transferred to the fluid. If fouling occurs, a deposit adheres to the heated surface and insulates a portion of the surface from the test fluid. The insulating deposit reduces the rate of heat transfer to the fluid and its temperature decreases. The rate of change in the fluid temperature is a measure of the rate of fouling.

The time over which temperature measurements are recorded was set at 3 hours. By doing this, the changes in temperatures of several fluids can be used as a measure of their relative fouling tendencies.

When testing the anti-foulant activity of additives, the conditions are set so as to allow the fluid temperature at the outlet to drop about 50° F. during the test period. Except for the most unstable fluids, the temperature of the heated surface is normally significantly higher than that in the field application in order to effect fouling within the time of the test. Because of this acceleration of the test, the results are qualitative.

The following Examples are provided for illustrative purposes only and are not to be construed as limiting the invention herein described.

Unless specified otherwise, as used herein, all parts and percentages are by weight and based on the weight of the treated oil.

EXAMPLES 1-5

In carrying out the tests of the Examples, crude oil was utilized, which was a blend of primarily West Texas Sour crudes and had the following general characteristics:

TABLE II

| | |
|---|---|
| C7 Asphaltenes (Wt %) | 0.80–2.0 |
| Elemental Analysis | |
| Carbon (Wt %) | 85.32 |
| Hydrogen (Wt %) | 12.86 |
| Oxygen (Wt %) | 0.56 |
| Nitrogen (Wt %) | 0.11 |
| Sulfur (Wt %) | 1.17 |
| Toluene Insolubles (Reflux) | |
| Wt % | 0.050 |
| Liquid Chromatography | 0.050 |
| Saturates (%) | 77–86 |
| Neutral Aromatics (%) | 10–17 |
| Polar Aromatics (%) | 3–8 |
| and exposed to the following test conditions in the Thermal Fouling Tester: | |
| Metal temperature (°C.) | 372 |
| Oil Circulation rate (cc/Min) | 3.0 |
| Preheating (°C.) | 21 |
| Pressure (psig) | 500 |
| Time (hours) | 3.0 |

The combination of the invention (an equal weight mixture of a stream from a refinery catalytic cracking unit containing a preponderance of alkylated thiophene-containing polycondensed aromatic/naphthenic compounds as seen from its mass spectrometric analysis (Table III) and having a boiling point of 270° C. to 510° C. and a macrocyclic polyamine having 6 nitrogens per molecule and obtained from the reaction of polyisobutylene succinic anhydride (SAP number is 65 and a molecular weight of about 1400) and the appropriate polyamine (which macrocyclic is identified hereinafter as PIBSA-6N) was compared with the anti-foulant activity of PIBSA-6N alone, the said alkylated thiophenic compounds (identified therein as ATC) and that of a commercially available anti-foulant (designated as product C) in above described sour crude oil.

TABLE III

| Molecular Formula | Typical Name | Wt. % | $(\overline{M}n)$ |
|---|---|---|---|
| $C_nH_{2n-16}$ | Acenaphthenes | 1.54 | 218 |
| $C_nH_{2n-18}$ | Phenanthrenes | 8.95 | 243 |
| $C_nH_{2n-20}$ | Naphthenophenanthrenes | 9.78 | 254 |
| $C_nH_{2n-22}$ | Pyrenes | 15.40 | 253 |
| $C_nH_{2n-24}$ | Chrysenes | 8.70 | 265 |

TABLE III-continued

| Molecular Formula | Typical Name | Wt. % | $(\overline{M}n)$ |
|---|---|---|---|
| $C_nH_{2n-26}$ | Cholanthrenes | 2.90 | 283 |
| $C_nH_{2n-14}S$ | Benzothiophenes | 1.00 | 295 |
| $C_nH_{2n-16}S$ | Indothiophenes | 1.45 | 280 |
| $C_nH_{2n-18}S$ | Naphthenonaphthothiophenes | 4.70 | 249 |
| $C_nH_{2n-20}S$ | Acenaphthyleneothiophenes | 4.00 | 273 |
| $C_nH_{2n-22}S$ | Anthracenothiophenes | 3.80 | 261 |
| $C_nH_{2n-24}S$ | Naphthenophenanthrenothiophenes | 9.90 | 271 |
| $C_nH_{2n-26}S$ | Pyrenothiophenes | 1.20 | 295 |
| $C_nH_{2n-28}S$ | Chrysenothiophenes | 0.82 | 295 |
| $C_nH_{2n-30}S$ | Cholanthrenothiophenes | 0.50 | 299 |

The efficacy in inhibiting the accumulation of carbonaceous material on a preheater tube is indicated by the change in final temperature (ΔT) in °F. Table IV illustrates the anti-fouling activity of the process of the invention when practiced on the crude oil as earlier described.

TABLE IV

| Example | Added Additive | Dosage (ppm) Active Ingredient | Fouling ΔT (F.°) |
|---|---|---|---|
| 1 | — | 0 | 40 |
| 2 | ATC[a] | 50 | 31 |
| 3 | PIBSA-6N | 50 | 33 |
| 4 | Combination of the invention[b] | 50 | 33 |
| 5 | Product C[c] | 50 | 34 |

[a]refinery stream containing a preponderance of alkylated polycondensed aromatic/naphthenic compound with sulfur containing thiophenic structure having a boiling range of 270° C. to 510° C.
[b]equal weight parts of ATC and PIBSA-6N.
[c]commercially available anti-foulant of 50 weight percent active ingredient.

Generally the macrocyclic polyamine-alkylated thiophene combination additive mixture of the package will contain in concentration of said combination from 5 to 70, preferably 10 to 30, parts by weight of said combination based on the total weight of the package with additional dispersant(s)f and anti-oxidant(s) as desired. Broadly the weight ratio of combination to the other additive(s) possessing anti-foulant activity will range from 1:9 to 9:1, preferably 1:4 to 4:1, optimally 2:3 to 3:2 in the mixture which along with diluent constitutes the package. The diluent ranges in amount up to 80 weight percent, more usually about 50 weight percent.

The invention in its broader aspect is not limited to the specific details shown and described and departures may be made from such details without departing from the principles of the invention and without sacrificing its chief advantages.

What is claimed is:

1. A method for inhibiting deposit formation on the contact surfaces of structures confining heated hydrocarbon fluids comprising the step of introducing into said hydrocarbon fluids at least an inhibiting amount of thiophene-containing polycondensed aromatic/naphthenic compounds of number average molecular weight $(\overline{M}n)$ from 200 to 1,000 and a macrocyclic polyamine having 2 to 8 nitrogen atoms per molecule.

2. A method for inhibiting the accumulation of carbonaceous material on the inner surface of process equipment confining heated hydrocarbon oil comprising the step of dissolving into said hydrocarbon oil; at least 0.0005 weight percent of the combination of an oil soluble macrocyclic polyamine having 2 to 8 nitrogen atoms per molecule and oil-soluble alkylated ($C_2$–$C_{12}$) polycondensed aromatic/naphthenic compounds with a sulfur containing thiophenic structure and having a $\overline{M}n$ ranging from 200 to 1000.

3. An anti-foulant composition comprising an oil soluble macrocyclic polyamine compound having the formula:

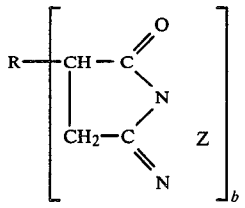

where R is a hydrocarbon having 20 to 15,000 carbon atoms, b is 1–150, and Z is:

$$-CH_2CH_2CH_2-;$$
$$(CH_2CH_2CH_2NH)_n-CH_2CH_2CH_2-$$

where n is 1–6 or:

$$(CH_2CH_2CH_2NH)_m CH_2CH_2-(NHCH_2CH_2CH_2)_{m'}-$$

wherein m+m' is 2–5 and an oil soluble (thiophene-containing) polycondensed aromatic/naphthenic compounds of number average molecular weight ($\overline{M}n$) from 200 to 1000.

4. A method for inhibiting the accumulation of carbonaceous material in a refinery unit during the passage of a hydrocarbon feed stock therethrough, which comprises dissolving in said feedstock a minor proportion of the combination of an oil-soluble macrocyclic polyamine compound having the formula:

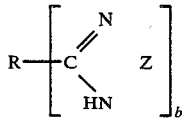

wherein R is hydrocarbon having 2 to 15,000 carbon atoms, b is 1–150, Z is:

$$-CH_2CH_2CH_2-;$$
$$(CH_2CH_2CH_2NH)_n-CH_2CH_2CH_2-$$

wherein n is 1–6 or;

$$(CH_2CH_2CH_2NH)_m CH_2CH_2(NH-CH_2CH_2CH_2)_{m'}$$

wherein m+m' is 2–5 and an oil soluble alkylated thiophene-containing polycondensed aromatic/naphthenic compounds of number average molecular weight ($\overline{M}n$) from 200 to 1000.

5. The method of claim 1 wherein the structures include a preheating heat exchanger of a refinery unit.

6. A method in accordance with claim 5 wherein there is at least one additional additive possessing anti-foulant activity.

7. A method according to claim 1 wherein there is also introduced with said compounds at least one other oil-soluble additive of the class of dispersants, antioxidants, antipolymerants, anti-foulants and mixtures thereof.

8. A method according to claim 7 wherein said other additive is polyisobutenyl succinimide of an alkylene polyamine.

9. A method according to claim 2 wherein said compounds are introduced as a refinery stream containing said compounds having a boiling range within the range of from 200° C. to 500° C. at atmospheric pressure.

10. An anti-foulant composition in accordance with claim 3 further characteristized in that R contains from about 60 to about 120 carbon atoms.

11. A method for inhibiting the accumulation of carbonaceous material in a refinery preheating unit during the passage of a hydrocarbon feed stock therethrough which comprises dissolving in said feed stock from about 0.0005 to about 0.0025 weight percent of the combination of an oil soluble polycyclic polyamine compound being the reaction product of a hydrocarbon succinic anhydride or carboxylic acid having 8 to 15,000 carbon atoms with an aza polycyclic ring compound containing 2 to 3 rings having 5 or 6 atoms per ring including 3 to 4 nitrogen atoms, at least one of which is an NH group and an oilsoluble alkylated thiophene-containing polycondensed aromatic/naphthenic compounds of number average molecular weight ($\overline{M}n$) from 200 to 1000.

12. An anti-foulant package comprising from 5 to 70 weight percent of the combination of an oil soluble macrocyclic polyamine compound having the formula:

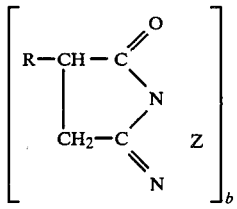

where R is a hydrocarbon having 2 to 15,000 carbon atoms, b is 1–150, and Z is:

$$-CH_2CH_2CH_2-;$$
$$(CH_2CH_2CH_2NH)_n CH_2CH_2CH_2-,$$

where n is 1–6 or:

$$(CH_2CH_2CH_2NH)_m CH_2CH_2(NH-CH_2CH_2CH_2)_{m'}-$$

wherein m+m' is 2–5 and an oil soluble alkylated thiophene-containing polycondensed aromatic compounds of number average molecular weight ($\overline{M}n$)from 200 to 1000 in a hydrocarbon oil diluent, said weight percent being based on the total weight of the package.

13. An anti-foulant package according to claim 12 wherein there is also present at least one other additive possessing anti-foulant activity.

14. An anti-foulant package according to claim 12 wherein said polyamine compound has been post-treated with a complex-forming metal selected from the group consisting of germanium, tin, antimony, or boron and phosphorous reactant.

* * * * *